US010583958B2

(12) United States Patent
Guerin

(10) Patent No.: US 10,583,958 B2
(45) Date of Patent: Mar. 10, 2020

(54) CONTAINER FOR PRESERVED FOOD WITH A FLEXIBLE BOTTOM, AND CORRESPONDING PRODUCTION METHOD

(71) Applicant: COMPAGNIE GÉNÉRALE DE CONSERVE, Theix (FR)

(72) Inventor: Jean-Michel Guerin, Vannes (FR)

(73) Assignee: COMPAGNIE GENERALE DE CONSERVE, Theix (FR)

( * ) Notice: Subject to any disclaimer, the term of this patent is extended or adjusted under 35 U.S.C. 154(b) by 184 days.

(21) Appl. No.: 15/554,538

(22) PCT Filed: Mar. 4, 2016

(86) PCT No.: PCT/EP2016/054649

§ 371 (c)(1),
(2) Date: Aug. 30, 2017

(87) PCT Pub. No.: WO2016/139341

PCT Pub. Date: Sep. 9, 2016

(65) Prior Publication Data

US 2018/0072456 A1 Mar. 15, 2018

(30) Foreign Application Priority Data

Mar. 4, 2015 (FR) ..... 15 51795
Aug. 26, 2015 (FR) ..... 15 57949

(51) Int. Cl.

| | |
|---|---|
| ***B65D 6/28*** | (2006.01) |
| ***B65D 17/50*** | (2006.01) |
| ***B65D 6/00*** | (2006.01) |
| ***B65D 8/00*** | (2006.01) |

(52) U.S. Cl.
CPC ..... *B65D 17/502* (2013.01); *B65D 7/12* (2013.01); *B65D 15/10* (2013.01)

(58) Field of Classification Search
CPC ..... B65D 7/12; B65D 15/10; B65D 15/06; B65D 15/18; B65D 15/24; B65D 7/502; B65D 7/501; B65D 7/50; B65D 17/12; B65D 17/18; B65D 17/50; B65D 17/501; B65D 17/502
See application file for complete search history.

(56) References Cited

U.S. PATENT DOCUMENTS 2,406,900 A 9/1946 Punte et al.
3,079,031 A 2/1963 Henchert
(Continued)

FOREIGN PATENT DOCUMENTS

EP 0 442 770 A1 1/1991
EP 1 878 666 A1 1/2008
(Continued)

OTHER PUBLICATIONS

International Search Report and Written Opinion, PCT/EP2016/054649.
(Continued)

*Primary Examiner* — Stephen J Castellano
(74) *Attorney, Agent, or Firm* — Polsinelli PC

(57) ABSTRACT

The invention relates to a container for preserved food comprising a metal body having at least one end closed hermetically by a bottom formed by a flexible film.

18 Claims, 5 Drawing Sheets

(56) References Cited

U.S. PATENT DOCUMENTS

| | | | | | |
|---|---|---|---|---|---|
| 3,434,651 | A * | 3/1969 | Stec | B65D 3/22 229/123.1 |
| 4,940,158 | A * | 7/1990 | Farrell | B65D 51/20 220/258.2 |
| 5,770,290 | A * | 6/1998 | McHenry | B21D 51/383 428/43 |
| 2002/0190109 | A1* | 12/2002 | Mrgan | B65D 15/06 229/5.5 |
| 2011/0278298 | A1* | 11/2011 | Zaggia | B65D 17/505 220/270 |
| 2012/0043324 | A1 | 2/2012 | Baker et al. | |

FOREIGN PATENT DOCUMENTS

| | | | | |
|---|---|---|---|---|
| EP | 2 019 045 | A1 | | 1/2009 |
| FR | 2 604 976 | A1 | | 4/1988 |
| FR | 2 639 561 | A1 | | 6/1990 |
| FR | 2 662 422 | A1 | | 11/1991 |
| FR | 2 813 502 | A1 | | 3/2002 |
| GB | 2244254 | A | * | 11/1991 |
| WO | WO 94/21532 | A1 | | 9/1994 |
| WO | WO 02/45949 | A1 | | 6/2002 |
| WO | WO 03/035391 | A2 | | 5/2003 |
| WO | WO 2004/073982 | A1 | | 9/2004 |
| WO | WO 2013/010875 | A2 | | 7/2012 |

OTHER PUBLICATIONS

Dossier—Ouverture Facile—Toute l'information sur l'Emballage, pp. 1-5.

P. Laborde, "Fabrication De Conserves Alimentaires," Universite De Toulouse Le Mirail, pp. 1-18.

* cited by examiner

CONTAINER FOR PRESERVED FOOD WITH A FLEXIBLE BOTTOM, AND CORRESPONDING PRODUCTION METHOD

RELATED APPLICATIONS

This application is a national stage application (under 35 U.S.C. § 371) of PCT/EP2016/054649, filed Mar. 4, 2016, which claims benefit of French application FR 551795, filed Mar. 4, 2015 and French application FR 1557949, filed Aug. 26, 2015.

1. FIELD OF THE INVENTION

The field of the invention is that of agri-food business.

The invention relates more particularly to the containers intended to preserve foodstuffs for a long period.

The invention relates also to the bottoms and the method for manufacturing such containers.

2. PRIOR ART

Metal cans allow for a long conservation of the foods that they contain. They consist of a metal body and two rigid metal bottoms which are generally secured to the body by crimping to make it into a sealed container.

The food products contained in these cans, once the latter are closed, undergo a high temperature heat treatment, notably at a temperature higher than 110° C. (sterilization). In this way, these food products can be preserved for several months at room temperature.

During the heat treatment, the body of the can is generally subjected to positive and/or negative pressure stresses depending on the method used, which can lead to deformations of the packaging and result in a variation of the internal volume of the can. These mechanical stresses are exerted on all of the can and require the body and the two metal bottoms to have a relatively significant thickness to avoid an irreversible deformation of the can.

The weight and the costs of raw material of such a container are, consequently, relatively high.

Another drawback with this type of can lies in the difficulty in opening the packaging. In effect, since the thickness of the metal bottom is relatively great so as to withstand the internal pressure variations, opening can prove difficult.

There are in fact these days three opening principles

- opening with a can-opener: the lid has no opening system.
- total ring opening (see below): a ring secured to the previously cut lid is lifted and then pulled. This is by far from the most widely used system and is growing steadily. In 2007, 86% of the cans were equipped with easy opening (the rate was 77% in 2002).
- Peelable opening: by pulling on the tab, a heat-sealed aluminum cap is detached from the can to offer a total opening. This new system is mainly used for nomadic products (salads, desserts, etc.), but is not suited to the cans that have to undergo a sterilization, because the force required (the opening effort (initial tearing force) is generally of the order of 20 N, but generally less than 28 N) to separate the cap is less than that exerted by an internal overpressure observed during the sterilization.

The ring system aims to make it possible to easily open the cans that have a metal bottom thickness that is relatively great, making it possible to withstand the internal pressure variations. This system implements, on one of the two metal bottoms, a gripping ring making it possible to open a part of the metal bottom, previously embrittled (by a cut for example).

Such a solution proves impractical as a relatively high effort is still required from the user to lift the ring and remove the lid by pulling on the ring. Furthermore, this solution does not make it possible to limit the weight of such packaging (on the contrary, it requires an additional element, namely a gripping ring).

The peelable system implements a body and a metal bottom, the can being closed by a lid consisting of a peelable foil secured to a conventional metal bottom which is previously emptied. The assembly is then crimped onto the perimeter of the top part of the metal body. The peelability is in particular and preferentially measured according to the method described in FR 2955844, peeling of the cap at 90° at a speed of 300 mm/min), making it possible to measure the initial tearing, yield and final tearing forces.

A drawback of this technique lies in the relatively high cost of manufacturing such a can. Indeed, the manufacturing method is substantially identical to that which makes it possible to obtain a conventional can but requires, in addition, steps of cutting of the metal bottom and of securing of the foil to the metal bottom.

Another drawback with this solution lies in the losses of material brought about by the cutting of the metal bottom to be hollowed out. In effect, this hollowed-out material cannot be reused.

Furthermore, the implementation of such a solution proves complex and offers the risks of sealing defect, particularly for cans that have to be sterilized, since the foil is required to be both peelable (that is to say not to be attached too strongly to the hollowed-out bottom to be able to be removed easily by applying a moderate force) and nevertheless withstand the strong pressure variations which occur during the sterilization of the container.

In other words, there is currently no can:

- that offers easy opening,
- that makes it possible to reduce the raw material requirements and costs,
- that guarantees a good resistance to the pressure variations during sterilization and an optimal seal-tightness of the can, and
- that allows simple and inexpensive manufacture.

3. SUMMARY OF THE INVENTION

The aim of the present invention is to solve the weaknesses of the prior art solutions and therefore propose a can comprising a metal body having a top part closed hermetically by a first bottom formed by a foil.

In a particular embodiment, said can comprises a metal body having a top part closed hermetically by a first bottom and a bottom part closed hermetically by a second bottom. According to this embodiment of the invention, said first and second bottoms are each formed by a foil.

A can is therefore proposed which has, at one of its ends or at each of its ends, a bottom in the form of a film or of a foil.

When the can has only one flexible bottom at one of its ends, the other bottom can notably be a "conventional" bottom, that is to say crimped to the metal body of the can according to the methods known in the prior art. It is also possible to envisage having the second bottom of the can in fact being the same mass as the metal body, which is observed when the can is manufactured by stamping and/or drawing from a metal sheet.

These cans are notably of great interest for the sterilization operations: the flexibility of the flexible bottom or of the two bottoms and their greater capacity to be deformed reversibly (compared to the conventional metal bottoms) during pressure stresses, varies the internal volume of the can, thus absorbing some of the pressure stresses undergone by the container as a whole.

The body of such a can therefore undergoes less pressure stresses than a can body implementing conventional metal bottoms, in industrial sterilization conditions.

In other words, the flexible bottom or bottoms contribute more to the variation of the volume of the interior of the can than the rigid metal bottoms.

Such an approach allows for an overall reduction of the weight of the materials needed to manufacture such a can compared to a conventional metal can with two rigid metal bottoms.

Indeed, in addition to the implementation of flexible bottoms, the reduction of the stresses on the body of the can makes it possible to reduce the thickness of the body.

It should be noted that the flexible bottom or bottoms used to close the cans are not peelable bottoms, and that they must be fixed to the can in such a way that they can withstand the internal pressure of the can during the sterilization, if necessary.

The description below presents various technical aspects which are implemented for performing the invention in its different aspects.

It is recalled that the invention is based on the use of a flexible film to block at least one end of a can of can for preserved food type, without said film being peelable.

In a first aspect, the invention relates to a can comprising a metal body having an end closed hermetically by a first bottom formed by a foil. In this aspect of the invention, it is particularly preferred when said bottom is fixed onto the can to withstand the sterilization. The internal pressure of the hermetically closed can is equal to atmospheric pressure or can be slightly lower than atmospheric pressure. This aspect of the invention aims to solve the problem of the quantity of material used to manufacture cans, by reducing the material used, both for the bottom and, possibly, for the body of the can, while maintaining the sterilization ability of the can for the preservation of foods which are contained therein.

In a second aspect, the invention relates to a can which comprises a metal body having a top part closed hermetically by a first bottom and a bottom part closed hermetically by a second bottom, said first and second bottoms are each formed by a foil. In this aspect of the invention,

- the bottoms can optionally (although preferably) be fixed in such a way that the can filled with one or more food products (or non-food products) withstands the conditions of sterilization of said products. However, cans are also envisaged which have flexible films fixed onto the metal body, at their ends, without these cans being intended for sterilization (in particular, cans containing powdered milk, such as baby formula, are envisaged). In this embodiment (presence of two flexible films at the ends in the can not intended for sterilization), the fixing of at least one film can be less strong than for the cans intended for sterilization. Consequently, at least one of the two films (preferentially only one of the two) can be peelable. If, in this embodiment, the presence of two peelable films is also envisaged, this is not preferred, to avoid having the consumer easily open the can by both ends.
- the embodiment is also envisaged in which the internal pressure of the can (after sterilization, and in the standard storage conditions (room temperature, atmospheric pressure)) is slightly lower (up to 0.4 bar) than atmospheric pressure. In other words, the interior of the can is depressurized relative to the outside of the can (atmospheric pressure).

This aspect of the invention notably aims to solve the problem of the deformation of the "lower" bottom of the can after filling (the internal depressurization makes it possible to compensate the weight of the contents of the can and avoid a convex deformation of the flexible bottom, i.e. outward from the can). This aspect of the invention notably aims to ensure, on the one hand, a maximum protection of the flexible bottom in the steps of logistics, handling, conveyancing and storage of the can, by possibly also allowing a slight deformation of the flexible bottom toward the interior of the packaging (concave deformation). By avoiding the convex deformation, and even generating a concave deformation of the flexible bottom, it also becomes possible to ensure a better guarantee of acceptability of the product by the consumer. Indeed, the presence of a convex bottom (dished outward from the packaging) could indicate a product that is unstable or unfit for consumption (bulging).

In another aspect, the invention relates to a can comprising a metal body having at least one end hermetically closed by a bottom formed by a foil, welded onto the top part of said metal body, and such that the welded top part of said metal body of the can is folded/rolled so as to form a peripheral rim at said end of the can. As will be seen hereinbelow, also envisaged is the case in which each of the two ends of the can is closed by a flexible film. In this aspect of the invention, at least one film can be peelable or not, or the films are fixed in such a way that the can will withstand the sterilization conditions. In these aspects of the invention, it is also possible (or not) for the interior of the can after filling and closure to be depressurized in relation to the outside. This aspect of the invention notably aims to solve the technical problem of the handling and the storage of the cans having one or more flexible bottoms, said rim allowing a protection of the flexible bottom or bottoms, particularly on industrial lines or during placement on a shelf at the point of sale. Depending on the form of the rim, it will also make it possible to optimize the arranging and the storage of the cans.

In another aspect, the invention relates to a can having at least one bottom formed by a foil, said foil having a precut part. In this aspect of the invention, the can can comprise two flexible bottoms, have (or not) an internal depressurization relative to atmospheric pressure and/or have (or not) peripheral rims formed by the rolling/folding of the end of the metal body. This aspect of the invention aims to solve the technical problem of the opening of the can, by providing a technical solution (precut zone) aiming to allow easy opening of the can by facilitating the rupturing of the flexible bottom.

In another aspect, the invention relates to a can (preferentially filled with food products), having at least one bottom formed by a foil, the internal pressure in said can being lower than atmospheric pressure in ambient conditions.

The description below provides additional elements relating to the implementation of the invention, in its various aspects. Some of these technical elements will be applied optionally to certain aspects of the invention.

In this description, reference is made to atmospheric pressure (in ambient conditions), which corresponds to a pressure of 1.01325 bar±2%. The temperature of the ambient conditions is 20° C.

Structure of the Flexible Bottoms

According to a particular aspect of the invention, said foil comprises at least one metal layer, such as a layer of aluminum.

This makes it possible to guarantee, for a reduced thickness, a sufficient solidity of the foil so as to withstand the deformations which occur during the heat treatment of the can. Moreover, this metal layer is also useful to serve as a gas-tight barrier.

The flexible bottoms that can be used to close one or both ends of the can can thus be formed by several layers, and are known in the art and therefore obtained by known methods, such as lamination. It is however appropriate for one of its layers to be able to allow the welding with the body of the can.

Heat Treatment of the Cans/Resistance to the Pressure Induced

In a particular embodiment, the cans according to the invention must be able to withstand the sterilization conditions necessary to ensure the preservation of the products.

Generally, the sterilization is a heat treatment of a foodstuff aiming to destroy microorganisms, even spore-forming bacteria, and the enzymes causing corruption of the products (core temperature of the product higher than 105° C.), and ensure the cooking of the product.

The sterilizing value (Fo) of a heat treatment, which expresses the efficiency of a heat treatment, can be defined. The Fo is established in relation to the most heat-resistant spores (*Clostridium botulinum* spores). The higher the heat treatment temperature and the longer its duration, the higher the Fo. The Fo is expressed as the equivalent amount of time spent at 121.1° C. to obtain a destruction of the spore.

It is thus possible to define time-temperature pairings that are applied to the foodstuffs in order to sterilize them while maintaining a satisfactory sensory quality.

It should also be noted that the sterilization conditions are established as a function of the characteristics of the product (initial contamination, pH, texture and initial temperature), of the nature and of the format of the packaging (in particular, size of the cans) as well as the characteristics of the autoclave.

Thus, by way of illustration, the foodstuffs to be sterilized can have varied consistencies ranging from liquids such as fish soups, sauces, etc., to solids (foie gras, pâté, etc.), whereas some products include liquids and solid elements (preserved vegetables, meats in sauce). The consistency of the product influences the diffusion of the heat in the product: the more liquid a product, the more rapid the diffusion of the heat.

It will therefore be understood that the sterilization conditions depend on the nature of the products (vegetables or fruits, or other products) to be sterilized. Thus, the temperature curves and durations of application of these temperatures to the cans will be a function of the products contained in these cans.

In fact, the sterilization treatment proceeds in three distinct phases:

- heating up of the element to be sterilized: this element is placed in a hermetically closed sterilizer/autoclave.
- sterilization scale: the temperature conditions are reached and remain stable for a defined duration, in order to allow the sterilization of the product. The scale is adjusted so as to allow both the heat treatment of the product while preserving its sensory qualities.
- cooling: when the duration of the scale is reached, the product is cooled, either by replacing the heating fluid with cold water, or by dipping the element into a cold water bath. The aim is to allow the fast cooling of the foodstuffs, notably in order to stop the cooking and avoid overcooking.

In some embodiments, the heating up is performed by placing the can in the sterilizer and by then raising the temperature of the sterilizer. In this embodiment, the heating up within the can follows that of the sterilizer.

In other embodiments, the can is placed in a sterilizer for which the heating up has already been performed, which induces a thermal and pressure "shock" on the can. The following conditions (entry of the can into an enclosure at a pressure of 2.5-2.8 bar (as absolute pressure, that is to say an pressurization of 1.5-1.8 bar relative to atmospheric pressure) and a temperature of approximately 130° C., which induces a very strong external pressurization before the can is reheated) illustrate this embodiment.

The following conditions are conditions observed, dependent on the sterilizers used.

One sterilization treatment is as follows:

- the introduction of cans into an enclosure at approximately 2.8 bar and approximately 130° C. (i.e. an external overpressure of approximately 1.6-1.7 bar)
- maintaining of the cans in this enclosure for approximately 11-12 minutes (the internal temperature of the cans rises to 130° C., the internal pressure of the cans rises to approximately 4 bar, i.e. an internal pressurization of approximately 1.2-1.3 bar)
- cooling by abrupt switching of the cans to a temperature of approximately 50° C. (which drops to 25° C. in approximately 3 minutes) and atmospheric pressure (1 bar).

In this embodiment (and depending on the contents of the cans), the cans can undergo an internal pressurization of between −1.7 and 1.3 bar.

In another implementation, the following conditions can be applied:

- introduction of cans into an enclosure at approximately 2.5 bar and approximately 126° C. (a maximum external pressurization of approximately 0.4-0.5 bar is observed)
- maintaining of the cans in this enclosure for approximately 15 minutes (the internal temperature of the cans rises to 126° C., the internal pressure of the cans rises to approximately 3.5 bar, i.e. an internal pressurization of approximately 1.1 bar)
- cooling by abrupt switching of the cans to a temperature of approximately 50° C. (which drops to 25° C. in approximately 3 minutes) and atmospheric pressure (1 bar).

In this embodiment (suited to canned flageolet beans), the cans can undergo an internal overpressure of between approximately −0.5 and approximately 1.1 bar (the term approximately meaning the specified value+/−10%).

In another implementation, the following conditions can be applied:

- introduction of cans into an enclosure at approximately 2.6 bar and approximately 127° C. (a maximum external pressurization of approximately 1.4-1.5 bar is observed)
- maintaining of the cans in this enclosure for approximately 11 minutes (the internal temperature of the cans rises to 127° C., the internal pressure of the cans rises to approximately 3.6-3.8 bar, i.e. an internal overpressure of approximately 1.3 bar)

cooling by abrupt switching of the cans to a temperature of approximately 50° C. (which drops to 25° C. in approximately 3 minutes) and atmospheric pressure (1 bar).

In this embodiment (suited to canned beans), the cans can undergo an internal pressurization of between approximately −1.4 and approximately 1.3 bar (the term approximately meaning the specified value+/−10%).

In another implementation, the following conditions can be applied:

introduction of the cans into an enclosure at approximately 2.6 bar and approximately 127° C. (a maximum external pressurization of approximately 1.4-1.5 bar is observed)

maintaining of the cans in this enclosure for approximately 11 minutes (the internal temperature of the cans rises to 127° C., the internal pressure of the cans rises to approximately 3.6-3.9 bar, by an observed internal overpressure between approximately 1.1 and 1.5 bar)

cooling by abrupt switching of the cans to a temperature of approximately 50° C. (which drops to 25° C. in approximately 3 minutes) and atmospheric pressure (1 bar).

In this embodiment (suited to canned beans), the cans can undergo an internal pressurization of between approximately −1.4 and approximately 1.5 bar (the term approximately meaning the specified value+/−10%).

It can therefore be seen that the sterilization conditions are highly variable and will depend in particular on the nature of the food product present in the can (the conditions will be adapted so as not to affect the sensory qualities)

on the nature of the sterilizer/autoclave used (water, steam, etc.)

on the size of the can to be sterilized on the nature (in particular the initial temperature) of the cans at the start of the sterilization on the industrial constraints linked to the production in the factory (speed of the production lines, which can induce duration constraints on the sterilization step).

Generally, the cans according to the invention withstand an internal overpressure (corresponding to the difference between the pressure internal to the can and the external pressure) greater than or equal to 0.7 bar, 0.8 bar, preferably greater than or equal to 0.9 bar, preferably greater than or equal to 1 bar, preferably greater than or equal to 1.05 bar, preferably greater than or equal to 1.1 bar, preferably greater than or equal to 1.15 bar, preferably greater than or equal to 1.2 bar. In some embodiments, the cans withstand an internal pressurization that can range up to 1.5 bar.

The cans must withstand this internal overpressure for at least two minutes, preferably for at least three minutes, preferably for at least four minutes, preferably for at least five minutes, preferably for at least six minutes, preferably for at least seven minutes, preferably for at least eight minutes, preferably for at least nine minutes.

Such an internal pressurization is obtained by any method known to a person skilled in the art, by using sterilizers/autoclaves known in the art. The internal and external pressures are measured using sensors placed respectively in the can and in the autoclave, the internal pressurization being the difference between the internal pressure and the external pressure.

The cans are considered to withstand an internal pressurization when their integrity is maintained after application of the internal pressurization for the time mentioned above. That means that the cans "do not blow" under the effect of the pressurization, and that the flexible bottom is not torn or destroyed under the effect of this pressurization.

It will also be noted that, in certain sterilization conditions, the cans can undergo an external pressurization (that is to say that the external pressure will be greater than the internal pressure). Such is notably the case when the cans are introduced into an enclosure already in the temperature and pressure conditions used for the sterilization. The cans (for which the internal pressure is the atmospheric pressure) then undergo an external pressurization that can range up to 2 bar. The cans must therefore also withstand this external pressurization. If an internal depressurization in the can is envisaged in the ambient conditions (to act on the concavity of the flexible bottom), it will then preferentially be chosen to sterilize the cans just after hot-filling (that is to say when the temperature of the can is of the order of 35-40° C.), the internal pressure of the cans then being close to atmospheric pressure.

Thus, the cans according to the invention withstand an external pressurization (corresponding to the difference between the pressure external to the can and the internal pressure) greater than or equal to 0.4 bar, preferably greater than or equal to 0.5 bar, preferably greater than or equal to 0.6 bar, preferably greater than or equal to 0.7 bar, preferably greater than or equal to 0.8 bar, preferably greater than or equal to 0.9 bar, preferably greater than or equal to 1 bar, preferably greater than or equal to 1.1 bar, preferably greater than or equal to 1.2 bar, preferably greater than or equal to 1.3 bar, preferably greater than or equal to 1.4 bar, preferably greater than or equal to 1.5 bar, preferably greater than or equal to 1.6 bar, preferably greater than or equal to 1.7 bar. In some embodiments, the cans withstand an internal pressurization that can range up to 2 bar. That means that the cans "do not implode" under the effect of the external pressurization, and that the flexible bottom is not torn or destroyed under the effect of this pressurization. This external pressurization is generally observed for a period generally less than two minutes, even less than one minute.

It is also preferable, when the physical aspect of the cans is not affected after sterilization, that is to say when the cans retain their appearance (for example cylindrical if the metal body has been prepared in this form). Thus, if the cans being able to be deformed (both outward and inward) during the sterilization operations is envisaged, it is preferable for these deformations not to be irreversible, that is to say for the cans to revert to their initial form (i.e. the form that they had before entry into the sterilizer) after the sterilization operations. It is in fact desirable to avoid having the internal pressurization induce an irreversible deformation of the metal body, which would lead, for example, to "blown" cans which might not be accepted by the consumers. It will be recalled that this issue of non-irreversible deformation is already known to those skilled in the art for the sterilizations performed with the prior art can models: these cans also undergo internal and external pressurizations leading to slight deformations of the metal body, reversible after the sterilization phase, when the cans are once again subjected to ambient temperature and pressure conditions. A person skilled in the art is therefore used to assessing this parameter.

In conclusion, the cans must withstand an internal pressurization of between −0.4 bar and 0.8 bar or any other value mentioned above, preferably without undergoing irreversible deformation (that is to say a deformation of the metal body which is maintained) after return to ambient conditions. The negative internal overpressure corresponds to the external overpressure applied to the can.

Weight of the Cans

According to a particular aspect of the invention, for a can of so-called "4/4" standard format with a content of 850 ml, the weight of the metal body is less than 50 g (a conventional metal body of the prior art for this can format has a weight equal to 51 g).

Preferably, the weight of said metal body is less than 40 g.

The thickness of the metal body of the can according to the invention is substantially reduced inasmuch as the metal body undergoes fewer stresses than the metal body of a conventional can.

According to a particular aspect of the invention, the weight of said flexible bottom is less than 10 g.

Preferably, the weight of said flexible bottom is less than 5 g.

The weight of the flexible bottoms of the invention is substantially less than that of the known can bottoms.

It should be noted that the weight of a conventional rigid can bottom is equal to 16 g, the weight of a bottom with easy gripping ring opening is 22 g, whereas the weight of a peelable bottom is 10 g.

According to a particular aspect of the invention, the weight of said can according to the invention is less than 56 g.

The implementation of two flexible bottoms makes it possible to reduce the weight of the bottoms and of the body forming the can.

The weight of the can according to the invention is, consequently, reduced by comparison to the prior art cans whose weight is generally between 77 g and 89 g.

The reduction of the thickness of the bottoms and of the body of the can consequently allows for a relatively significant weight saving, and therefore a reduction of the material cost of the can.

Welding of the Bottom or Bottoms onto the Body of the can

According to a particular aspect of the invention, said first and possibly second bottoms are welded onto the top part and the bottom part respectively of said metal body (in particular by heat-sealing).

The flexible bottoms are directly welded onto the can, and more specifically onto the flat of the metal of the body of the can, at the ends of the body. The bottom or bottoms are welded onto the bottom face of the body of the can, onto flat annular flanges at the end of the body.

The flexible bottoms are not peelable. That means that it is not possible to break the welding of the bottom onto the can by applying a reasonable force (i.e. of the order of 20 N, force applied for the peelable bottoms). The initial tearing force to be applied in order to "peel" the bottoms from the metal body is therefore preferentially greater than 25 N, more preferably greater than 28 N, or than 30 N, even more preferably greater than 35 N.

Moreover, the flexible bottoms of the can are of a single piece, unlike the peelable bottoms developed under the trademark EASIP®. These Easip® peelable bottoms are constructed by placing a complex film based on aluminum onto a steel or a ring of steel or of aluminum crimped onto the body of the can (see for example WO 2012/072383), whereas the flexible bottoms described in the present application are directly welded onto the body of the can.

As indicated above, the welding of the flexible bottoms is robust enough to withstand the pressure stresses which occur during a heat treatment (sterilization) of the food content, and which are exerted, as stressed previously, partly on the flexible bottoms.

Such an approach (welding or heat-sealing directly onto the body of the can rather than onto a ring crimped onto the body of the can) allows the flexible bottoms a better withstand strength in sterilization compared to the peelable flexible bottoms of the prior art, which do not withstand the abovementioned pressurizations, observed during the sterilization. They are therefore more suited to the heat treatment systems causing strong pressure stresses.

The welding of the film onto the body of the can is performed by any method known in the art.

In particular, the edge of the can can be coated locally with a material suitable for making heat-sealing possible (organic and/or mineral material in which mineral and/or organic fillers can be incorporated, in particular polypropylene (PP)). This material will melt at the moment of the heat-sealing, then will cool to produce a solid joint, which allows the seal-tight fixing of the foil serving as bottom. The precise conditions (type of material, welding conditions) can easily be determined by a person skilled in the art by checking the appropriateness of the conditions to the specifications (pressure resistance conditions) defined above. These conditions are known in the art, the heat-sealing of a film on a material, by using, for example a heat sealer with flexible head).

If the aluminum or the steel of the body of the can is covered with a lacquer of polypropylene type (or filled with polypropylene particles), and the film also contains polypropylene, the heat-sealing (welding) can be performed by applying a pressure of between 20 and 70 kPa, for 0.25 to 4 seconds, with a temperature of between 160° C. and 220° C. The exact conditions of pressure and of duration of application of the pressure depend on the temperature applied. It is even possible to extend to durations greater than 4 seconds if manual equipment is used (manual heating clamp type equipment).

It is in particular possible to use the films of the Fastelfoil™ (Fastel Adhesive Products, San Clemente, Calif., United States), in particular the film of reference PP320, for which the manufacturer considers the application of a pressure between 3 and 10 psi (20 to 70 kPa) for 0.25 to 1 second at a temperature of 165 to 175° C.

A sealing (welding) for 2 sec at 200° C. with a flexible bottom whose bottom membrane (in contact with the body of the can) is of polypropylene, the lacquer of the can body being filled with this same material, is perfectly suited to the implementation for the application sought, and the production of a weld allowing the bottom to withstand the temperature and pressure conditions specified above.

Ends of the Metal Body

According to a particular aspect of the invention, the welded top and/or bottom parts of said metal body of the can are respectively folded/wound so as to form a peripheral rim at each end of the can.

The invention relates thus to a can comprising a metal body having a top part closed hermetically by a first bottom, characterized in that said first bottom is formed by a foil, and is welded onto the top part of said metal body, the welded top part of said metal body of the can being also folded/rolled so as to form a peripheral rim at the top end of the can. It is clear that the term "top" is relative and signifies one end of the can.

In this aspect of the invention, the welding of the flexible bottoms onto the can body is protected by a roll of the flat of the metal of the can body. This roll, or rim, is prominent and protects the flexible bottoms (and the weld) during the sterilization, transportation, handling and storage of the can.

This implementation is particularly suited when the two bottoms of the can are made of foils.

Thus, in another embodiment, the invention relates to a can comprising a metal body having a top part closed hermetically by a first bottom and a bottom part closed hermetically by a second bottom, characterized in that said first and second bottoms are each formed by a foil, said first and second bottoms being welded onto the top part and the bottom part respectively of said metal body, said welded top and bottom parts of said metal body of the can being respectively folded/rolled in such a way that each forms a peripheral rim at each end of the can. It is worth noting that, according to this aspect of the invention, it is not essential for the can or cans thus obtained to withstand the pressure conditions indicated above, even though that is preferred. One or both flexible bottoms can therefore be peelable.

According to a particular aspect of the invention, said rims are of different forms.

The form of the roll of the top bottom can be different from the form of the roll of the bottom and thus allows an optimized stacking of such cans while protecting the flexible bottoms.

The invention relates also to a method for manufacturing a can comprising:

- a step of fixing of a flexible bottom at an end of a metal body (in particular by welding said bottom onto a flat annular flange at said end of the body) followed by
- a step of rolling of the metal of said flat annular flange of the body of the can so as to form a roll, or rim, that is prominent (that is say above the plane in which said flexible bottom is situated).

Precutting/Opening of the can

As indicated above, the bottoms described in the present application are not peelable bottoms as described in the prior art. They cannot therefore be detached from the body of the can by exerting a "reasonable" pulling force that a user would exert to open a peelable flexible bottom (i.e. of the order of 20 N).

These bottoms must however be able to be easily opened by the users, which is possible by breaking them with any appropriate instrument, such as a knife blade. However, technical elements can be added to these bottoms, in order to further improve the opening of the cans.

Thus, and according to another particular aspect of the invention, said first bottom and/or said second bottom has/have a precut part.

Consequently, a can having one or two bottoms formed by a foil, and in which one and possibly the other foil has a precut part, is a subject of the invention. It is worth noting that the subject of the invention also includes any can thus defined, whether one or other of the bottoms is peelable, as long as at least one of the two bottoms has a precut part as described above. Thus, according to this aspect of the invention, it is not essential for the can or cans thus obtained to withstand the pressure conditions indicated above, even though that is preferred.

A precut, in particular by laser or similar technology, is implemented on at least one of the two flexible bottoms. This allows the consumer to easily perforate the flexible bottoms and thus open the can to access the food content. This precutting is performed once the heat treatment of the food content is finalized, when the flexible bottom is no longer required to undergo strong pressure stresses so as not to degrade the latter. It will be noted that this laser precutting, common in the art, allows a partial incision of the foil, while maintaining the impermeability to air in order to maintain the quality and the integrity of the product contained in the can. The foil is thus embrittled along a rupture line corresponding to the place of the precutting, which assists in the opening thereof.

According to yet another particular aspect of the invention, said precut part or parts is/are associated with a visual marking.

The precutting can be done on an ink premarking or the ink premarking can be performed once the precutting is finalized which will allow the consumer to better see the precut relative to the rest of the bottom of the can.

In another embodiment, a tab or a small gripping ring is glued onto the flexible bottom, and close to the precut zone, which can be pulled by the final user, in order to induce the rupturing of the embrittled zone, and thus improve the opening of the can.

The invention relates also to a method comprising a step of precutting of a flexible bottom blocking an end of a can, said precutting consisting of a partial incision of said foil, while maintaining the air-tightness of said bottom to air.

Form of the Cans

According to a particular aspect of the invention, said metal body has a truncated cone form.

The implementation of flexible bottoms at each of the ends of a can makes it possible to dispense with the conventional rigid bottom production standards and therefore the associated metal body forms.

A metal body in truncated cone form allows the cans be to be stacked one inside the other once empty.

This aspect makes it possible to limit the storage volume of the cans when the latter are empty, that is to say before filling or after the can has been used in particular.

The invention relates also to a can bottom formed by a foil intended to be implemented in a can as described previously.

According to a particular aspect of the invention, the foil comprises a metal layer (of aluminum, for example) covered on at least one face by a plastic layer.

A foil made up of such a succession of layers of different materials makes it possible to ensure a strong solidity of the foil so as to withstand the pressure variations which occur during the heat treatment, for example.

Manufacturing Method

The invention relates also to a method for manufacturing a can as described previously comprising:

- a step of welding of a flexible bottom to one end of a metal body.

The method can also comprise one or more of the following steps, performed before or after the step indicated above:

- a step of filling of the metal body with one or more food products;
- a step of crimping of a rigid bottom onto the other end of the metal body so as to hermetically close the can.

If the can is of stamped type, the filling of the metal body is performed before the above welding step.

In another embodiment, it is also possible to perform 1) a step of crimping (or equivalent) of a rigid bottom to one end of the can 2) a step of filling of the metal body with one or more food products 3) the step indicated above of welding of a flexible bottom to the other end of a metal body.

In another embodiment, it is also possible to perform 1) the step indicated above of welding of a flexible bottom to one end of a metal body 2) a step of filling of the metal body with one or more food products 3) a step of crimping of a rigid bottom to the other end of the can.

According to a particular aspect of the invention, the manufacturing method further comprises a step of working of the metal consisting in folding or rolling the welded part (before or after filling depending on the case) of said body of the can so as to form a peripheral rim at the end of the can, thus acting in particular as a protection of the flexible bottom.

The above method can also include a step of heat treatment (sterilization) of the can hermetically closed at its two ends.

According to another particular aspect of the invention, the manufacturing method also comprises a step of precutting of the flexible bottom in order to allow easy opening of the can.

This precutting preferentially occurs after the heat treatment since the latter provokes strong pressure stresses and it is therefore preferable for the flexible bottom not to be embrittled.

The invention relates also to a method of sterilization of a can as described above (comprising a metal body and hermetically closed by one or two flexible bottoms at (respectively) one or both ends of said metal body), comprising a step of placing said can in temperature and pressure conditions inducing an internal pressurization (in said can) of at least 0.8 bar (or any other value as indicated above). Preferably, in this sterilization method, said can undergoes the pressurization for at least two minutes (or any other duration indicated above, a preferred duration being greater than or equal to 6 minutes, or 7 minutes).

The invention relates also to a method for manufacturing a can as described previously comprising:

- a step of welding of a first flexible bottom onto the bottom part of the metal body;
- a step of filling of the metal body with one or more food products;
- a step of welding of a second flexible bottom onto the top part of the metal body so as to hermetically close the can;
- if necessary, a step of heat treatment (sterilization) of the can.

According to a particular aspect of the invention, the manufacturing method further comprises a step of working of the metal consisting in folding or rolling the bottom welded part (before filling) then the top welded part (after filling) of said body of the can so as to form a peripheral rim at each end of the can, thus acting as a protection of the flexible bottom.

According to another particular aspect of the invention, the manufacturing method comprises a step of precutting of at least one of the two flexible bottoms in order to allow an easy opening of the can.

This precutting occurs preferentially after the heat treatment since the latter provokes strong pressure stresses and it is therefore preferable for the flexible bottom not to be embrittled.

Such a manufacturing method can be implemented effectively, industrially.

Filling of the Cans

When the can has a flexible bottom at each of its ends, the weight of the content is likely to deform the bottom flexible bottom. The rim which can be placed at the bottom end can protect the flexible bottom and prevent the latter from touching the plane on which the can is placed, including when it is deformed by the weight of the content of the can (because of a sufficient space between (a) the point of contact of the rim and of the storage plane and (b) the flexible bottom); the rim production conditions and the space between the end of the rim and the flexible bottom are therefore adapted to the weight that the flexible bottom will be subjected to, as well as its strength and its deformability.

However, it is also possible to close the can (placing of the second bottom) in conditions such that the can will exhibit a slight internal depressurization (of the order of 0.1 to 0.4 bar) relative to atmospheric pressure. In this embodiment, the external pressurization will exert a force opposing the force exerted by the foods (weight) on the external bottom, which will not therefore deform, or only marginally.

This internal depressurization (relative to atmospheric pressure) can be obtained by conducting the step of hermetic closure of the can in a depressurization chamber. The filling step which precedes this step of closure of the can can also be performed in this depressurization chamber. These operating conditions are particularly suitable when the content of the can is a content at ambient temperature, in particular powdered milk (in particular baby formula), powdered chocolate, ground coffee, or similar.

When the food products are hot products (such as cooked dishes or cooked vegetables), it is possible to obtain this depressurization in ambient conditions by closing the can while the products have been added in the can while hot, and by keeping a certain quantity of air in the can. The captive air is thus at the temperature of the products. When the can is cooled, the cooling of the air will therefore induce a depressurization internal to the can. In this embodiment, it will preferentially be chosen to introduce the can into the sterilization chamber before the latter is cooled (that is to say when the temperature of the can is still higher than approximately 35° C.).

A can, closed by at least one flexible bottom at one of its ends (preferentially closed by flexible bottoms at both ends), and which is slightly depressurized internally relative to atmospheric pressure, is also the subject of the invention.

4. LIST OF THE FIGURES

Other features and advantages of the invention will become more clearly apparent on reading the following description of an exemplary embodiment, given as a simple illustrative and nonlimiting example, and the attached drawings, in which.

5. DETAILED DESCRIPTION OF THE INVENTION

5.1 General Principle

The invention relates therefore to a novel type of can comprising one or two bottoms, or lids, in the form of a foil. Such a can is distinguished from the known cans which implement rigid (relatively thick) metal bottoms at each of their ends.

These flexible bottoms are intended to absorb the pressure stresses to which the can is subjected when the latter undergoes a heat treatment (sterilization) intended to preserve the food products that it contains. The thickness of the body of the can can thus be reduced.

Consequently, the particular structure of the can according to the invention makes it possible to reduce the needs in terms of metal in relation to the current cans and reduces the manufacturing costs.

5.2 Structure of the can

One embodiment of a can according to the invention, comprising two flexible bottoms, is described hereinbelow in relation to FIGS. 1 to 6. These figures and the teaching hereinbelow are also applicable when the can contains only a single flexible bottom.

Figure 1:
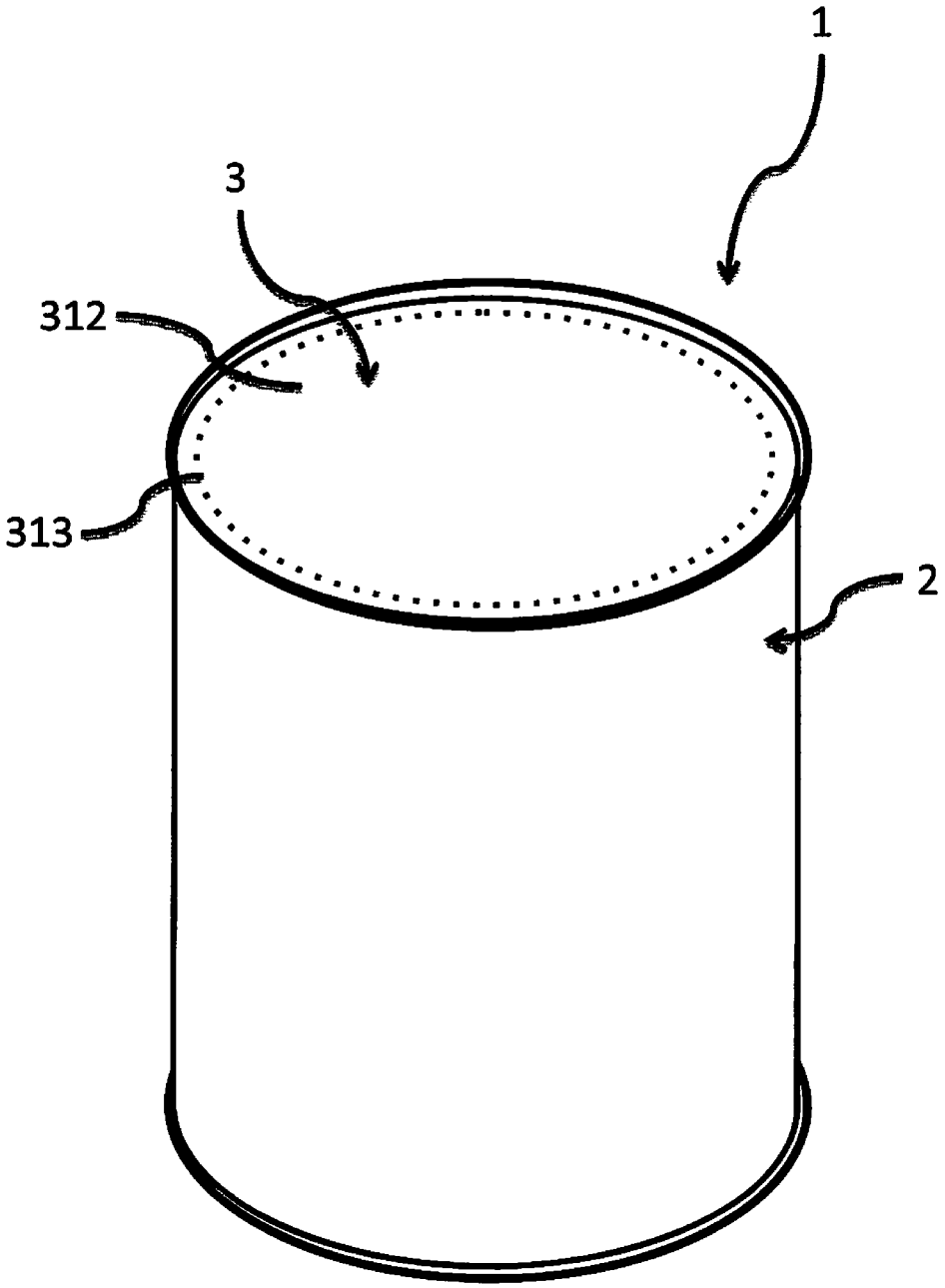
FIG. 1 is a perspective view of a can according to the invention, comprising two flexible bottoms.

As illustrated in FIG. 1, the can 1 comprises a metal body 2 of cylindrical section. The metal body 2 is secured at both its ends to a flexible bottom 3 to produce the hermetic closure of the can 1.

Figure 2:
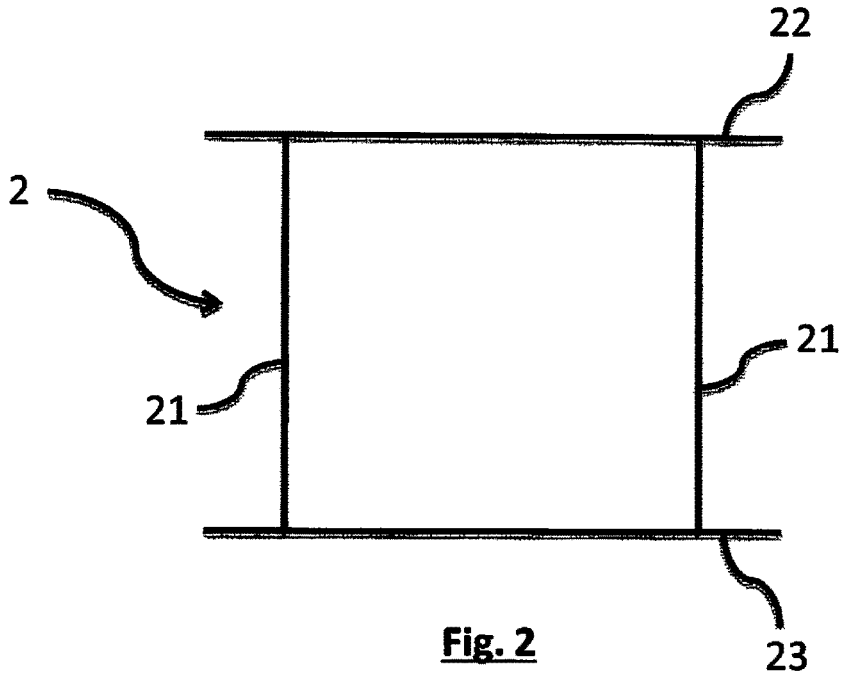
FIG. 2 is a schematic view in cross section of the metal body of the can of FIG. 1 during the manufacturing thereof.
Figure 3:
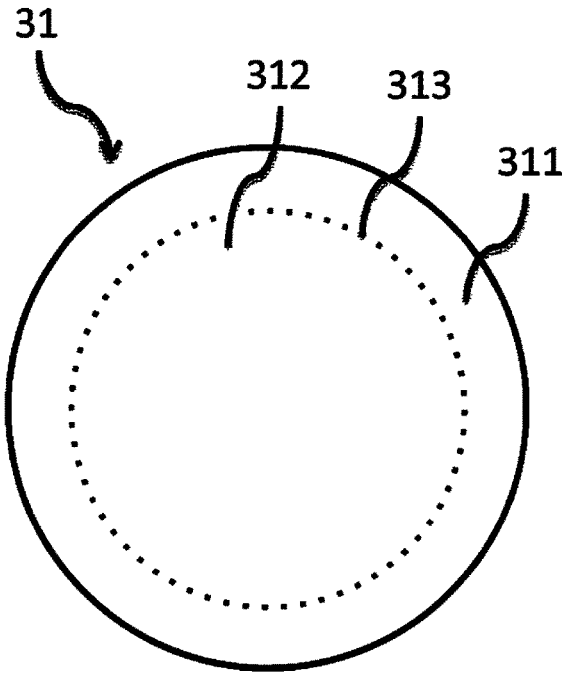
FIG. 3 illustrates an example of a foil that can be used on a can according to the invention showing the precut part intended to facilitate the opening of the can.

The metal body 2, which is preferably of steel or aluminum, has, in longitudinal cross section, a substantially parallelepipedal profile, as illustrated in FIG. 2.

The profile shows two rectilinear and parallel walls 21 ending at each of their ends with flat annular parts 22, 23 which extend at right angles to the walls 21, over the perimeter of the opening (these flat parts 22, 23 are deliberately overdimensioned in FIG. 2 for clarity).

The flat parts 22, 23 are each intended to receive a flexible bottom.

For this, flexible bottoms 3, in the form of a foil 31, are affixed respectively onto the top 22 and bottom 23 parts before being secured thereto by welding (induction or resistance welding, for example). The welding has to be strong/resistant enough to ensure an optimal strength of the flexible bottoms 3 during the heat treatment (sterilization) of the can 1.

The peripheral part or perimeter 311 of the foil 31 is therefore directly welded onto the flat annular parts 22, 23 of the metal body 2.

Figure 5:
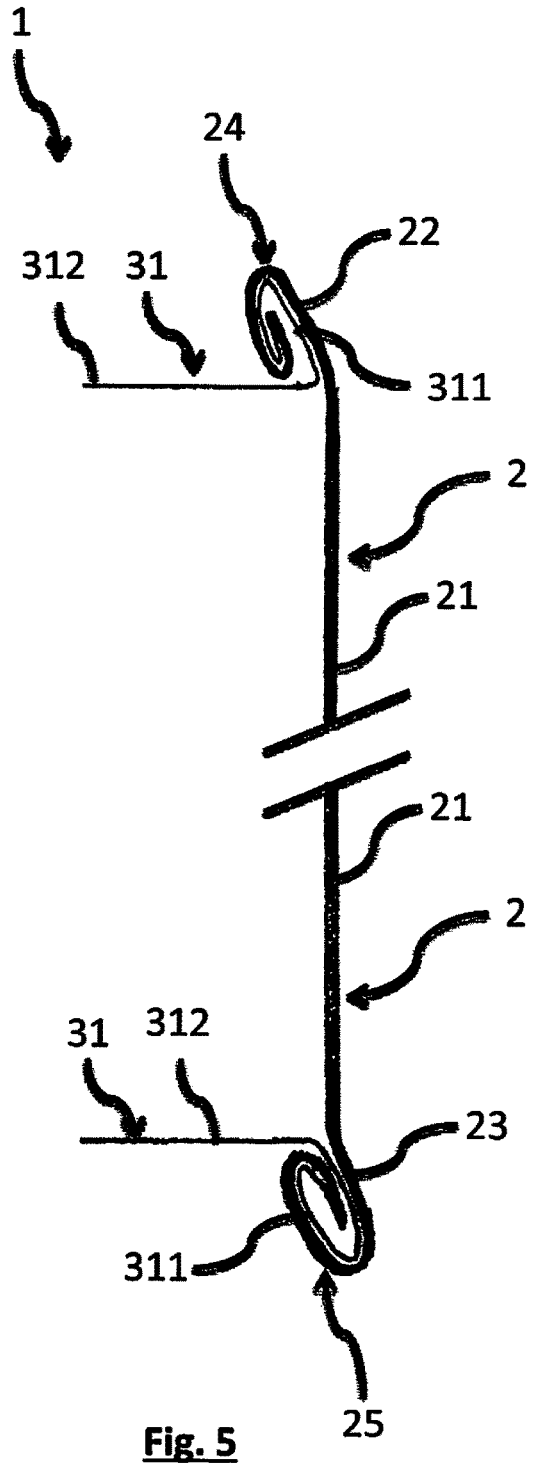
FIG. 5 is a partial schematic representation, in cross section, of the top and bottom joins between the metal body and the foil of the can of FIG. 1.

Once the foils 31 are secured to the metal body 2, the top 22 and bottom 23 parts are rolled on themselves, as illustrated in FIG. 5.

This rolling, in double folded seam form for example, forms a top rim 24 and a bottom rim 25 respectively encompassing the top part 22 and the bottom part 23 of the metal body 2 and the peripheral part 311 of the corresponding foil 31.

Such a rim makes it possible to protect the foils 31 from the impacts and frictions that could possibly degrade the seal-tightness of the can 1, particularly during the handling and the transportation of the can 1 (in automatic conveyor systems, for example).

Figure 6:
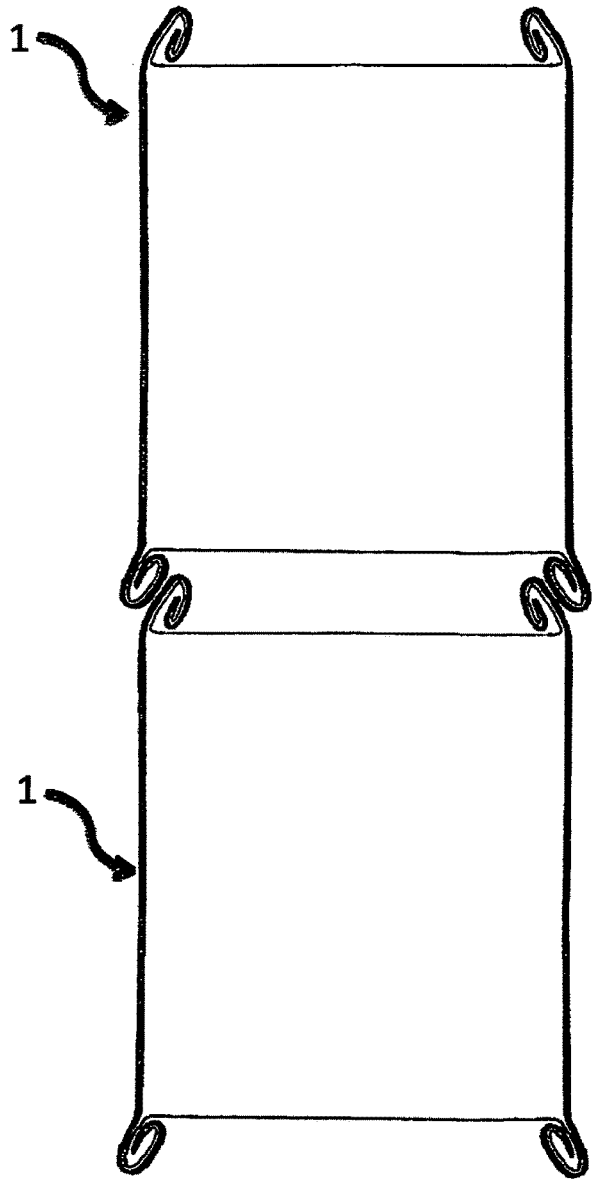
FIG. 6 illustrates an example of storage of two cans according to the invention, in particular when they have two flexible bottoms.
Figure 7:
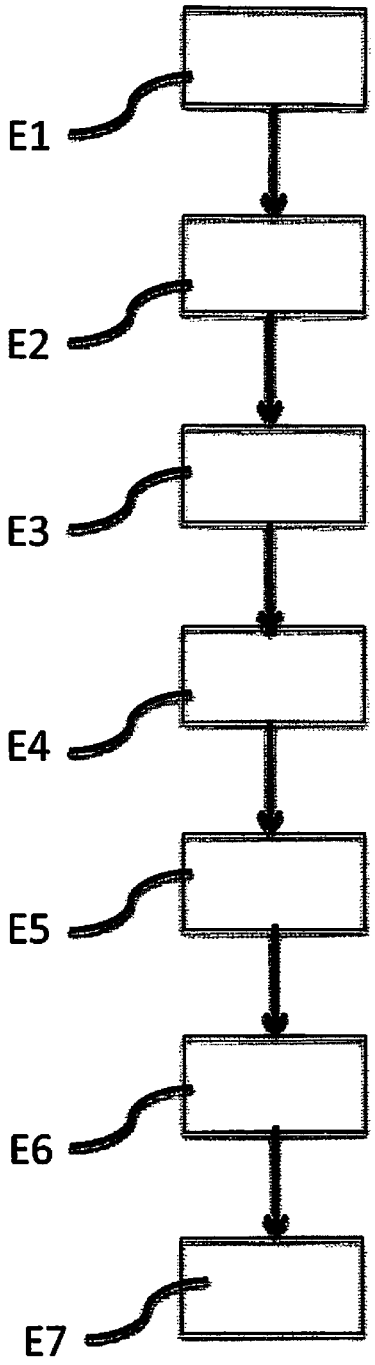
FIG. 7 illustrates the main steps of the method for manufacturing a can according to the invention, comprising two flexible bottoms, and as described in the examples.

Note that the top rim 24 is oriented toward the interior of the can 1 and that the bottom rim 25 is oriented toward the exterior of the can 1. This allows a stable stacking and optimized storage of the cans 1, one on top of the other, as illustrated in FIG. 6. It is however also possible to envisage a top rim 24 oriented toward the exterior of the can 1 and a bottom rim 25 oriented toward the interior of the can 1.

5.3 Structure of the Flexible Bottom

The flexible bottom 3 of the invention is formed by a foil 31 made up of one or more layers. The layers can consist of different materials, such as polypropylene, aluminum or polyethylene.

Figure 4:
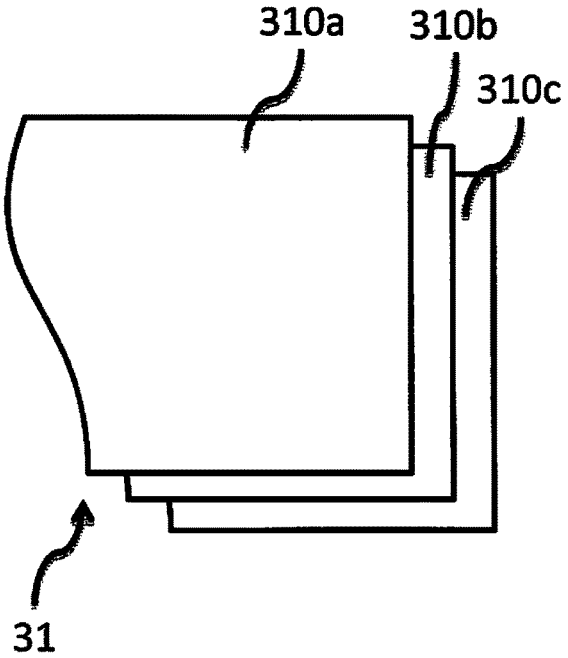
FIG. 4 is an exploded view of the various layers that make up a foil according to the invention.

In the example illustrated in FIG. 4, the foil 31 of the flexible bottom 3 comprises two plastic layers 310*a* and 310*c* between which is inserted a metal foil, an aluminum foil 310*b* in this example.

Such a combination of materials allows an optimal resistance while guaranteeing a strong flexibility of the flexible bottom 3, that is to say that the foil is capable of being stretched without breaking.

The implementation of an aluminum foil 310*b* in such a flexible bottom 3 makes it possible to guarantee a reliable oxygen barrier. This aspect contributes to the long-term preservation of the sterilized foodstuffs which then allows for long-term ambient storage.

The plastic layer 310*c* situated between the aluminum foil 310*b* and the flat parts 22, 23 ensures an optimal sealing of the flexible bottoms 3 on the metal body 2 of the can.

Such a flexible bottom 3 also has a small thickness and a reduced weight.

In fact, for a so-called 4/4 standard format can, the flexible bottom 3 has a weight of less than 10 g, and more specifically less than 5 g.

Preferably, the weight of the flexible bottom 3 is equal to 3 g.

If these values are compared to those of the bottoms of the cans of the prior art, namely 16 g for a standard rigid bottom, 22 g for a rigid bottom with easy opening by a gripping ring and 10 g for a peelable bottom, it can be seen that the weight saving, and therefore material saving, is relatively significant.

The implementation of a flexible bottom 3 at each of the ends of the metal body 2 makes it possible to relieve the body of the can of the stresses linked to the pressure variations between the interior and the exterior of the can 1, during sterilization in particular.

Indeed, the flexible bottoms 3 are capable of being deformed reversibly, so as to vary the internal volume of the can thus making it possible to absorb the pressure variations.

In other words, the flexible bottoms 3 allow the can 1 to inflate and shrink upon pressure variations occurring during the heat treatment.

Since the metal body 2 is less stressed during the heat treatment, its thickness, and therefore its weight, are reduced relative to a conventional can.

Still for a can of standard 4/4 format, a conventional metal body has a weight of the order of 51 g.

The implementation of two flexible bottoms according to the invention allows for the implementation of a metal body 2 of reduced thickness and having a weight less than 50 g.

Preferentially, the weight of the metal body 2 is less than 40 g.

Consequently, a can 1 according to the invention, implementing two flexible bottoms of 3 g each and a conventional can body (50 g) has a maximum total weight of 56 g. The cans of the prior art which have a conventional 51 g body, a conventional 16 g rigid bottom and a peelable 10 g bottom have a weight of 77 g, which is much greater.

The weight saving of the can 1 of the invention is therefore at least 15 g.

5.4 Easy Opening of the can

One of the foils 31 of the can 1 has a precut 313 which is intended to embrittle the flexible bottom 3 and allow an easy opening of the can 1.

The precut 313 of the flexible bottom 3 is implemented in a conventional way, preferably by a laser cutting technique.

This operation is performed after sterilization of the can 1 so as not to embrittle the flexible bottom 3 which has to guarantee an optimal seal-tightness of the can 1. In effect, as stressed previously, during the sterilization, the flexible bottom 3 is subjected to significant stresses due to the pressure variations internal to the can 1.

This precut 313 is indicated to the user through an ink tracing, by dotted line for example.

When the user wants to open the can 1, it is sufficient for him or her to apply a relatively low pressure to the part 312 of the foil 31 situated within the precut 313, in proximity thereto. This pressure, which can be applied using a spoon for example, causes the part 312 of the flexible bottom 3 situated within the precut 313 to break and allows the user to access the content inside the can.

Thus, the opening of the can 1 of the invention requires no particular tool and does not require any significant effort on the part of the user. This approach allows for easy opening (opening requiring only a little effort and no particular tool) and guarantees an optimal seal-tightness of the can 1.

5.5 Method for Manufacturing the can

The can of the invention is obtained by a different manufacturing method compared to that of the cans of the prior art.

When the can has two flexible bottoms, such a manufacturing method comprises:

- a step of welding E1 of a first flexible bottom 3 onto a first flat part 23 (bottom part) of the metal body 2;
- preferentially, a step of folding/rolling E2 of the bottom part 23 on itself to form a rim 25;
- a step of filling E3 of the metal body 2 with one or more food products;
- a step of welding E4 of a second flexible bottom 3 onto the second flat part 22 (top part) of the metal body so as to hermetically close the assembly;
- preferentially, a step of folding/rolling E5 of the top part 22 on itself to form a rim 24;
- preferentially a step of heat treatment (sterilization) E6 of the can 1;
- preferentially, a step of precutting E7 of at least one of the two flexible bottoms 3 in order to allow for an easy opening of the can 1.

Note that the method for manufacturing such a can according to the invention does not require the implementation of a crimping operation.

5.6 Other Aspects and Variants

The structure of the can according to the invention offers an optimal resistance to the pressures undergone during the sterilization of the food content.

The can according to the invention offers easy opening for the user and guarantees a perfect seal-tightness.

Such a can is also lightweight, robust, simple and inexpensive to manufacture.

Moreover, the precut can take forms other than a circular form.

The implementation of a flexible bottom according to the invention makes it possible to dispense with the conventional metal bottom production standards and therefore consider the production of cans of varying forms.

Figure 8:
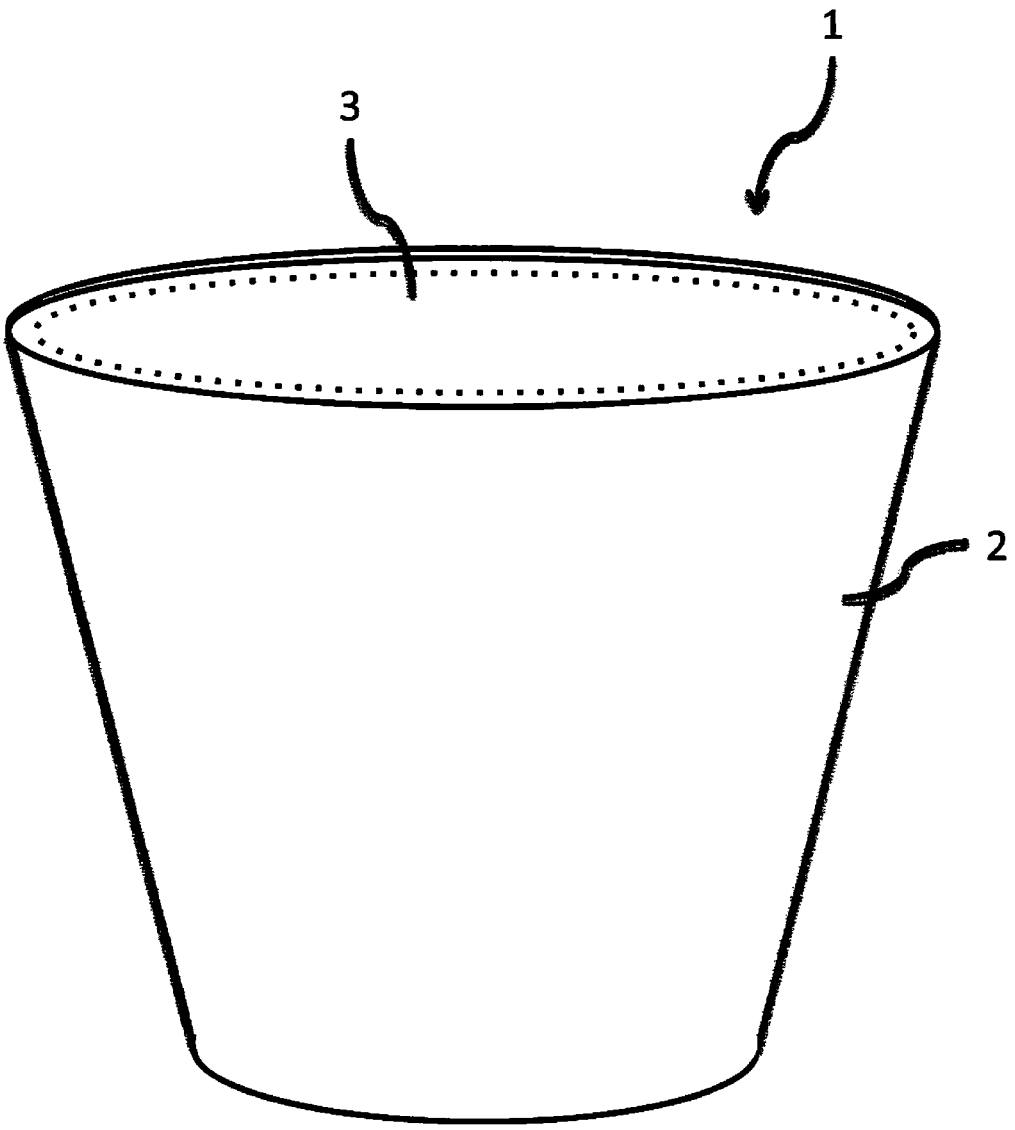
FIG. 8 is a perspective view of another form of can according to the invention.

FIG. 8 shows a can 1 having a can body 2 in truncated cone form, the diameter of the bottom flexible bottom (not visible) being less than that of the top flexible bottom 3.

This particular form makes it possible to stack the tapered cans one on top of the other stably, but also one inside the other, compactly, once the cans are empty.

The stacking of the cans one inside the other can be performed before the can is filled and/or after the content of the can has been consumed.

The invention claimed is:

1. A can (1) comprising a metal body (2) having a top part (22) closed hermetically by a first bottom (3) and a bottom part (23) closed hermetically by a second bottom (3), characterized in that the first bottom is formed by a foil (31) forming a flexible bottom, directly welded onto the metal body (2) so as to withstand the pressure stresses during a heat treatment (sterilization) of the can (1), wherein the flexible bottom is not peelable.

2. The can (1) as claimed in claim 1, characterized in that said first bottom (3) has a precut part (313), consisting of partial incision of the foil while maintaining the impermeability to air, to allow later easy opening of the can.

3. The can (1) as claimed in claim 2, characterized in that the precut part (313) is associated with a visual marking.

4. The can as claimed in claim 1, characterized in that the second bottom (3) is also formed by a foil (31).

5. The can (1) as claimed in claim 1, characterized in that said foil (31) comprises at least one metal layer (310*b*).

6. The can (1) as claimed in claim 1, characterized in that, for a standard 850 ml can, the weight of the metal body (2) is less than 50 g.

7. The can (1) as claimed in claim 4, characterized in that said first and second bottoms (3) are welded onto the top part (22) and the bottom part (23) respectively of said metal body (2).

8. The can (1) as claimed in claim 7, characterized in that the top (22) and bottom (23) parts of the metal body (2) of the can (1) are respectively folded/rolled so as to form a peripheral rim (24, 25) at each end of the can (1).

9. The can (1) as claimed in claim 8, characterized in that said rims (24, 25) are of different forms.

10. The can (1) as claimed in claim 1, characterized in that said metal body (2) has a truncated cone form.

11. A method for manufacturing a can (1) as claimed in claim 1, characterized in that it comprises a step of welding a flexible bottom to an end of the metal body, in conditions allowing said flexible bottom to withstand the pressure stresses which occur during a heat treatment of the can (1).

12. The method as claimed in claim 11, characterized in that the welding of the flexible bottom onto the end of the metal body is performed by heat sealing.

13. The method as claimed in claim 12, characterized in that said flexible bottom has a bottom membrane of polypropylene, that is heat sealed onto the end of the metal body covered with a polypropylene-filled lacquer.

14. The method as claimed in claim 11, characterized in that it also comprises one or more of the following steps, performed before or after the step indicated in claim 11:

- a step of filling the metal body with one or more food products;
- a step of crimping a rigid bottom onto the other end of the metal body so as to hermetically close the can.

15. The method as claimed in claim 11, characterized in that the can is of stamped type, and that the filling of the metal body with one or more food products is performed before the welding step of claim 11.

16. The method for manufacturing a can as claimed in claim 11, characterized in that it further comprises a step of folding/rolling the welded part of said body of the can so as to form a peripheral rim at the end of the can.

17. The method for manufacturing a can as claimed in claim 11, characterized in that it comprises a step of heat treatment (sterilization) of the can hermetically closed at its two ends.

18. The method for manufacturing a can as claimed in claim 11, characterized in that it further comprises a step of precutting the flexible bottom in order to allow easy opening of the can, preferentially after heat treatment.

* * * * *